US007267609B2

(12) United States Patent
Hackett

(10) Patent No.: US 7,267,609 B2
(45) Date of Patent: Sep. 11, 2007

(54) DUAL PURPOSE SANDING AND COLLECTING ABRADING DEVICE

(76) Inventor: John J. Hackett, 1532 Whisping Woods Dr., Williamstown, NJ (US) 08094

( * ) Notice: Subject to any disclaimer, the term of this patent is extended or adjusted under 35 U.S.C. 154(b) by 0 days.

(21) Appl. No.: 11/222,194

(22) Filed: Sep. 8, 2005

(65) Prior Publication Data

US 2007/0054609 A1 Mar. 8, 2007

(51) Int. Cl.
*B24D 15/00* (2006.01)

(52) U.S. Cl. ..... 451/527; 451/533; 451/540

(58) Field of Classification Search ..... 451/526, 451/534, 539, 442, 451, 461, 462, 540, 544, 451/527, 533

See application file for complete search history.

(56) References Cited

U.S. PATENT DOCUMENTS 3,629,896 A 12/1971 Simec
3,998,012 A * 12/1976 Ness ..... 451/523
4,484,419 A 11/1984 Freerks
4,974,369 A * 12/1990 Dixon ..... 451/523
5,392,482 A * 2/1995 Drulias et al. ..... 15/104.94
5,429,545 A * 7/1995 Meyer ..... 451/523
6,016,571 A 1/2000 Guzman et al.
6,530,830 B2 3/2003 Rich et al.
6,604,244 B1 8/2003 Leach
6,688,958 B1 * 2/2004 Jones et al. ..... 451/557
6,733,378 B1 * 5/2004 Tank et al. ..... 451/540

* cited by examiner

*Primary Examiner*—Jacob K. Ackun, Jr.
(74) *Attorney, Agent, or Firm*—Cheryl F. Cohen, LLC

(57) ABSTRACT

A dual purpose abrading device for smoothing, sanding or finishing a surface of an object while simultaneously surrounding, collecting and containing the particles or debris as they are being generated. The abrading device includes a porous member having a collecting surface with a recess defined therein and a three dimensional abrading member adapted in shape and size to be received within the recess of the porous member. When the abrading member is inserted into the recess of the porous member the abrading member has an exposed abrading surface at least a portion of which is covered with an abrading material. The abrading member is circumscribed by the porous member thereby surrounding, collecting and containing the particles or debris as it is being produced by the abrading device.

19 Claims, 3 Drawing Sheets

DUAL PURPOSE SANDING AND COLLECTING ABRADING DEVICE

BACKGROUND OF THE INVENTION

1. Field of the Invention

The present invention is directed to a dual purpose abrading device for sanding or smoothing an object to be finished while simultaneously collecting and containing the debris, particles and dust as it is being produced.

2. Description of Related Art

For years sanding blocks having an abrasive outer coating or layer have been used to sand, smooth or finish a surface of an object. Sanding blocks may be rigid comprising a non-deformable substrate (e.g., made of wood, metal, plastic or other non-deformable material) covered by or coated with an abrasive material (e.g., sandpaper). The rigidity of the substrate lends this device particularly well suited to sanding substantially flat surfaces such as walls). Other sanding blocks are designed so as to be deformable or pliable thereby permitting its surface to adapt in shape complementary to that of the object being sanded or smoothed. A common example of such sanding block is a porous material (e.g., foam or sponge) that has an abrasive coating or layer.

Sanding instruments have been designed to take shapes other than that of a rectangular block. U.S. Pat. No. 6,604,244 discloses a work glove having a glove member including a wrist portion, a palm portion, and a plurality of digit portions. A plurality of hook and loop fasteners sections are fixedly coupled to the front surface of the glove member along the palm and digit portions. To the hook and loop fasteners sections a plurality of pads are selectively attached. The glove member is made of a resiliently elastomeric material, preferably neoprene so as to protect the user from chemicals and the drying effects of water. Therefore, the work glove does not absorb or collect the debris, particles and dust as it is being produced. Another disadvantage is that the glove requires the purchase of specific pads that are complementary in shape to those of the hook and loop fastener sections. Since the glove is made of a deformable material that is shaped to accommodate the user's hand, it is not particularly well suited for sanding of a substantially planar surface.

For sanding of a substantially planar surface such as drywall, U.S. Pat. No. 6,530,830 teaches a sanding disc comprising a circular abrasive disc having an abrasive surface, and a circular foam disc smaller in diameter than the abrasive disc which is coaxially adhered to the surface of the abrasive disc opposite its abrasive surface. An inner opening in the foam disc is smaller in size than that of the abrasive disc. The foam disc is adhered to the abrasive disc and thus not independently replaceable. In addition, since the diameter of the abrasive disc is larger than that of the foam disc such that the outer region of the foam disc is not exposed the foam merely serves as a cushion for the abrasive disc and does not collect the debris, particles and dust being generated. A portion of the foam disc proximate its inner opening is exposed, however, it is circumscribed by the abrasive portion and therefore fails to surround, collect or contain the debris, particles or dust generated by the abrasive disc.

In a similar arrangement, U.S. Pat. No. 4,484,419 discloses a block for wet abrading comprising an ergonomic shaped body having a planar bottom surface with an opening defined therein extending via a conduit into a cavity within the body for receiving a liquid. A porous member is received in the conduit of the body. An abrasive material is held to the bottom surface of the body and has an opening defined therein aligned with the opening in the bottom surface of the body. The porous member is formed of a material which permits the controlled passage of liquid as its exposed wiping end portion is brought into contact with and passed over the surface being finished during an abrading operation in a sufficient quantity to wet at least a portion of the surface with liquid. In order to maintain the wetness of the surface of the object as it is being finished the porous member is circumscribed within the circular disc of abrasive material. This arrangement, however, precludes the sponge from surrounding, containing and collecting the debris, particles and dust as also does the disbursement of liquid therefrom which discharges the debris, particles and dust along with the liquid.

When using a sanding device the debris, particles and dust generated create a mess by floating freely in the air and falling onto all surfaces. None of the aforementioned conventional sanding devices recognize much less address the problem of surrounding, collecting and containing unwanted debris, particles and dust generated during sanding, smoothing or finishing of an object.

It is therefore desirable to develop an improved inexpensive dual purpose abrading device that sands, smoothes or finishes an object while simultaneously surrounding, collecting and containing the debris, particles and dust being generated.

SUMMARY OF THE INVENTION

An object of the present invention is to design an abrading device that solves the aforementioned problems associated with conventional abrading devices.

Another object of the invention is to design an abrading device that serves a dual purpose of both sanding or smoothing an object to be finished while simultaneously surrounding, collecting and containing the debris, particles and dust as it is being produced.

Still another object of the invention is to design an abrading device that is interchangeable for use with either a rigid or a deformable abrading member.

The present invention relates to a dual purpose abrading device for smoothing, sanding or finishing a surface of an object while simultaneously surrounding, collecting and containing the debris, particles and dust as it is being generated. The abrading device includes a porous member having a collecting surface with a recess defined therein and a three dimensional abrading member adapted in shape and size to be received within the recess of the porous member. When the abrading member is inserted into the recess of the porous member the abrading member has an exposed abrading surface at least a portion of which is covered with an abrading material. The abrading member is circumscribed by the porous member thereby surrounding, collecting and containing the debris, particles and dust as it is being produced by the abrading device.

BRIEF DESCRIPTION OF THE DRAWING

The foregoing and other features of the present invention will be more readily apparent from the following detailed description and drawings of illustrative embodiments of the invention wherein like reference numbers refer to similar elements throughout the several views and in which.

DETAILED DESCRIPTION OF THE PREFERRED EMBODIMENTS OF THE INVENTION

Figure 1:
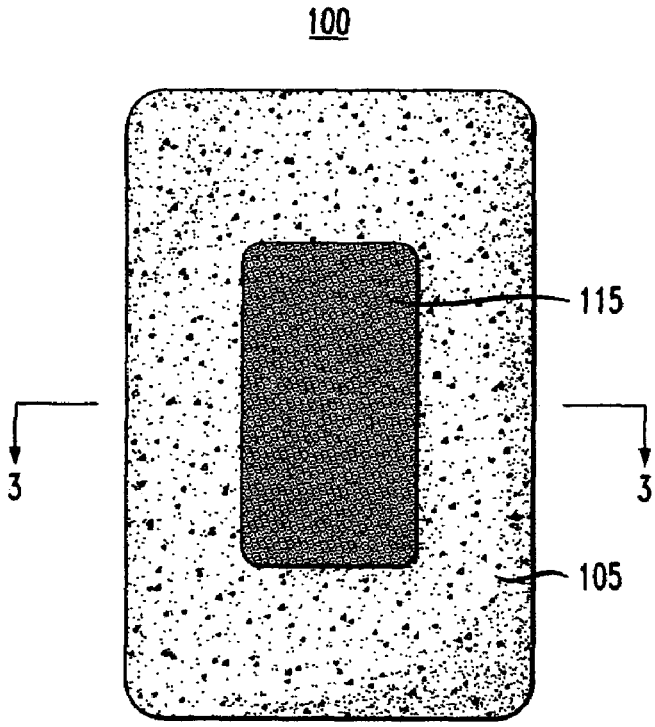
FIG. 1 is a front view of an exemplary embodiment of the abrading device in accordance with the present invention.
Figure 2:
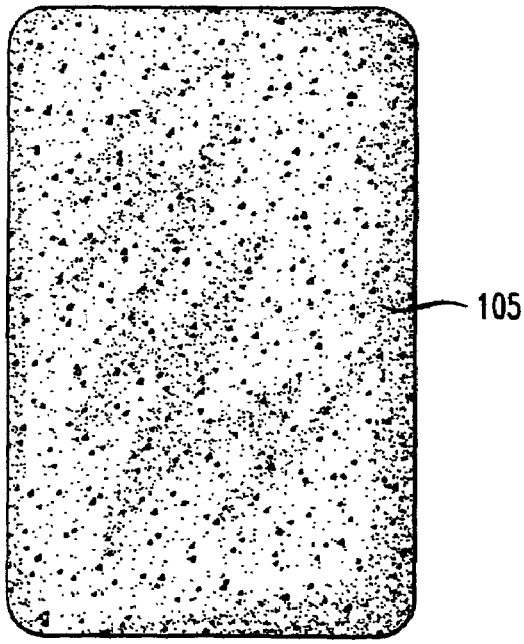
FIG. 2 is a back view of the abrading device of FIG. 1.
Figure 3:
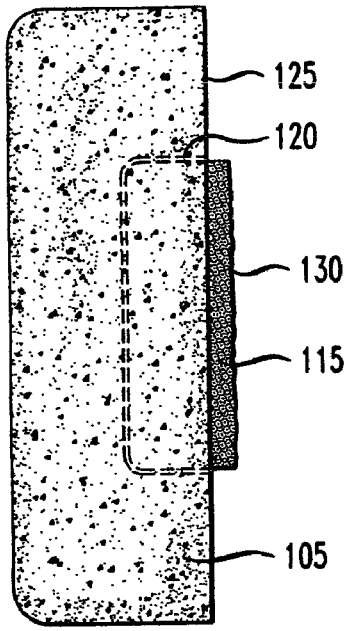
FIG. 3 is a side view of the abrading device of FIG. 1.
Figure 4:
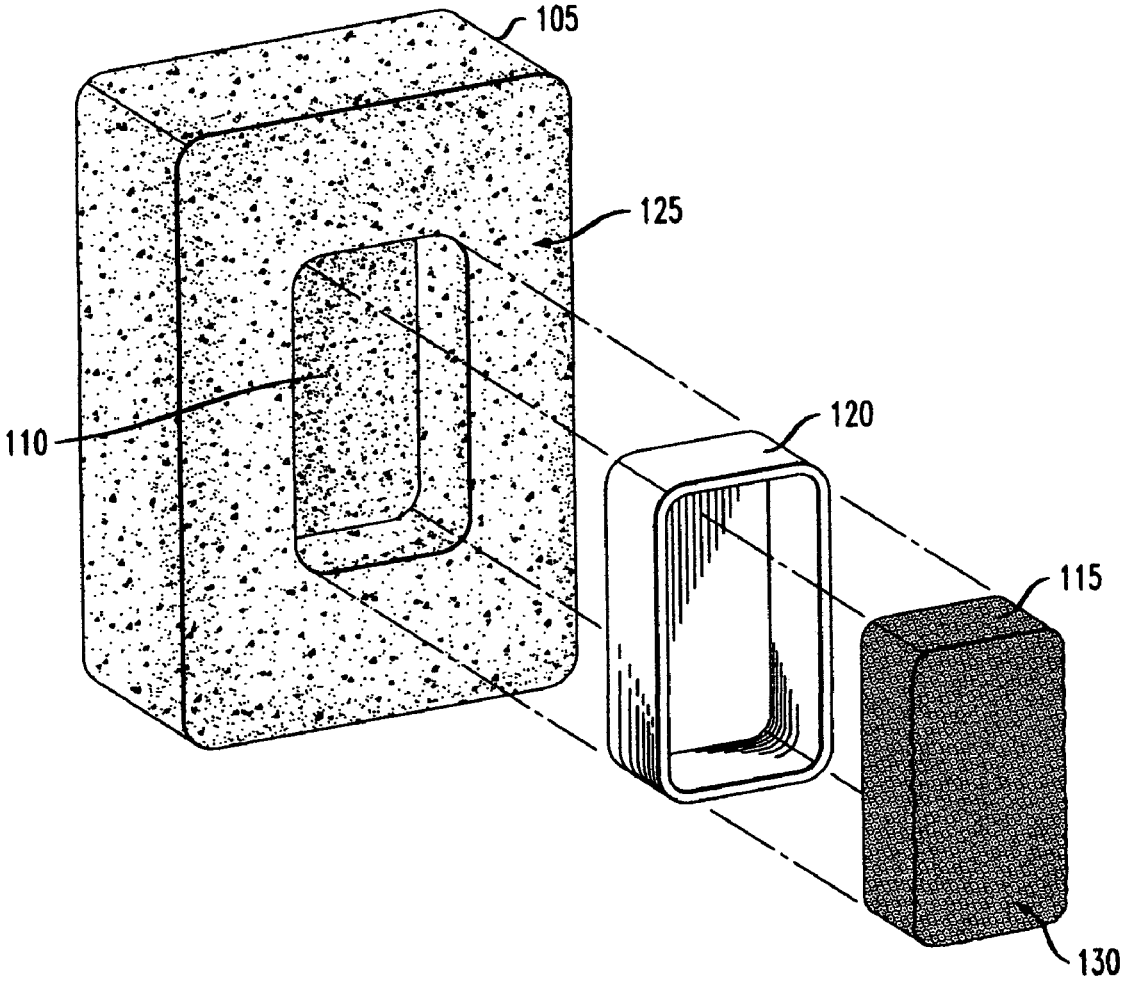
FIG. 4 is an exploded view of the abrading device of FIG. 1.
Figure 5:
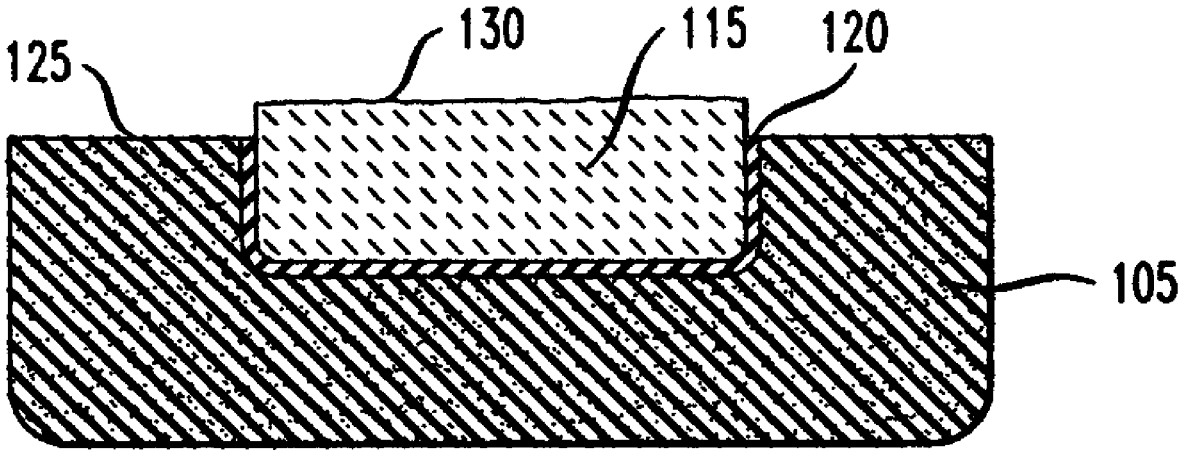
FIG. 5 is a cross-sectional view of the abrading device of FIG. 1 along the line 3-3.

An exemplary embodiment of the abrading device 100 in accordance with the present invention is shown in FIG. 1. Abrading device 100 includes a porous member 105 made from any deformable porous material such as foam or sponge that is capable of simultaneously collecting the particles and debris generated while abrading or sanding an object. Porous member 105 has a collecting surface 125 with a recess 110 defined therein complementary in size and shape to receive a three-dimensional abrading member 115. The shape of the recess 110 is complementary to that of the abrading member 115 thereby forming a friction fit therebetween to retain the abrasive member in the recess. In a preferred embodiment, recess 110 extends only partially in depth through porous member 105 so as to optimize the friction fit between contacting surfaces of the abrading member 115 and porous member 105 so as to retain it in place therein. In the case in which the recess 100 extends through the porous member 105 from its collecting surface 125 to its opposite surface, there will be one less contacting surface (i.e., the opposite surface) with which to form a friction fit thereby increasing the possibility of dislodgement. Most preferably, recess 110 extends greater than or approximately equal to half of the depth of the porous member 105, but less than the total depth of the porous member 105, as shown in FIG. 5. Preferably, the depth of recess 110 is slightly less than the depth of the abrading member 115 so that when abrading member 115 is inserted into recess 110, an exposed abrading surface 130 of abrading member 115 extends just beyond that of the collecting surface 125 of the porous member. For example, the exposed abrading surface 130 extends beyond the collecting surface of the porous member by a distance less than or equal to approximately 5 mm, preferably at a distance of approximately 2 mm. Additional retention of the abrading member 115 in the recess 110 of porous member 105 is provided by the user when he grasps the assembled abrading device squeezing the deformable porous member 105 about the abrading member 115 prior to abrading the surface of the object to be finished.

Lining or frame 120 may optionally be disposed inside recess 110 to protect the porous member 105 from being torn or worn away by the abrading surface of the abrading member 115 during use. The lining or frame 120 is adapted in size and shape to be received in recess 110. In a preferred embodiment, lining or frame 120 is made from a material having a non-smooth surface (i.e., traction) so as to maintain a friction fit between the abrading member 115 and recess 110 of porous member 105. By way of example, the lining or frame 120 may be made of rubber or a material having a fibrous surface. Alternatively, a smooth lining such as a plastic liner or frame may be employed and alternative releasable retaining means such as hook and eye fasteners used to secure the abrading member 115 in the recess 110 during use. The lining or frame 120 may be permanently affixed in the recess 110. Alternatively, lining or frame 120 may be releasably retained in recess 110, for example, via a friction fit, so as to be readily replaceable.

Typically the abrading member 115 is a substantially rectangular sanding block covered on at least four of its longitudinal surfaces with an abrasive material, as shown in the Figures. When such an abrading member 115 is inserted into the recess 110 its plural abrasive surfaces will provide additional friction with the contacting surfaces of the porous member 105 thereby further reducing the chance of removal. It is however contemplated and within the intended scope of the invention to employ alternative or additional releasable retaining means by which the abrasive member is secured in the recess of the porous member such as by complementary hook-and-eye attachment means secured within the recess 110 and on one or more surfaces of the abrading member 115 in contact therewith when installed therein. Whatever means are used to retain abrading member 115 in recess 110 it is preferable that abrading member 115 remain readily replaceable or interchangeable rather than permanently affixed therein.

When the device is assembled, abrading member 115 is circumscribed by porous member 105 so as to surround, collect and contain the debris, particles and dust as it is being produced by the abrading member. As an object is being finished or sanded the debris, particles and dust generated therefrom are surrounded, collected and contained by the collecting surface 125 of the porous member 105 thereby substantially minimizing airborne debris, particles and dust which, in turn, reduces cleanup thereafter. When the porous member 105 becomes filed or saturated with debris, particles and dust, the abrading member 115 may be removed and the porous member 105 run under water to flush out the debris, particles and dust therein. Abrading member 115 may be easily removed from recess 110 of porous member 105 and replaced or interchanged with another abrading member. This allows the user to employ abrading members possessing a wide spectrum of characteristics or properties tailored for specific and varying applications. For example, size, material and amount of grit of the abrading material on at least a portion of the exposed abrading surface 130 of abrading member 115 may be varied based on the object being finished, for example, wood, metal or drywall. In addition, after the exposed abrading surface has worn abrading member 115 may be flipped and/or rotated relative to porous member 105 to a expose a different abrading surface. If all abrading surfaces have become worn then a new abrading member 115 may be interchanged or replaced. Since the abrading member may be interchangeable, the present invention allows the user to select the abrading member to have either a rigid or deformable substrate depending on the object being finished. If the object is a drywall to be sanded than a rigid abrading member may be selected, on the other hand a curved object may lend itself to the use of an abrading member having a deformable substrate.

The overall shape and size of the porous member and/or abrading member may be modified as desired, so long as the shape of the abrading member and the recess defined in the porous member are complementary to permit the abrading member to be received therein. It is advantageous to design the recess of the porous member to accommodate conventional sized and shaped sanding blocks therein. That way, the abrading member may be interchangeable with sanding blocks that are readily available in any hardware or home store.

The present inventive abrading device is particularly useful for sanding drywalls especially when the substrate of the abrading member is manufactured of a rigid or semi-rigid material. On the other hand, the invention is equally suitable for finishing of non-planar objects when a deformable material is employed as the substrate for the abrading member that may adapt in shape to substantially conform with that of the object. Thus, the invention is adaptable for use with a wide variety of applications and projects.

Thus, while there have been shown, described, and pointed out fundamental novel features of the invention as applied to a preferred embodiment thereof, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps that perform substantially the same function, in substantially the same way, to achieve the same results be within the scope of the invention. Substitutions of elements from one described embodiment to another are also fully intended and contemplated. It is also to be understood that the drawings are not necessarily drawn to scale, but that they are merely conceptual in nature. It is the intention, therefore, to be limited only as indicated by the scope of the claims appended hereto.

Every issued patent, pending patent application, publication, journal article, book or any other reference cited herein is each incorporated by reference in their entirety.

What is claimed is:

1. A dual purpose abrading device comprising:

a porous member having a collecting surface with a recess defined therein; and a three dimensional sanding block adapted in shape and size to be received within the recess of the porous member, when inserted into the recess of the porous member the sanding block having an exposed abrading surface at least a portion of which is covered with sandpaper, the sanding block being circumscribed by the porous member.

2. The device in accordance with claim 1, wherein the exposed abrading surface of the sanding block extends beyond the collecting surface of the porous member.

3. The device in accordance with claim 2, wherein the exposed abrading surface of the sanding block extends beyond the collecting surface of the porous member by less than or equal to approximately 5 mm.

4. The device in accordance with claim 1, wherein the exposed abrading surface of the sanding block is substantially flush with the collecting surface of the porous member.

5. The device in accordance with claim 1, wherein the sanding block is friction fit within the recess defined in the porous member.

6. The device in accordance with claim 1, further comprising a liner adapted in shape and size to be received in the recess.

7. The device in accordance with claim 6, wherein the liner is made of a material having a surface to form a friction fit with that of surfaces of the sanding block in which it contacts.

8. The device in accordance with claim 6, wherein the liner is made of a smooth material.

9. The device in accordance with claim 8, further comprising releasable retaining means disposed between contacting surfaces of the sanding block and the liner.

10. The device in accordance with claim 6, wherein the liner is replaceable.

11. The device in accordance with claim 1, wherein the sanding block is interchangeable within the recess.

12. The device in accordance with claim 1, wherein the sanding block comprises a rigid substrate at least a portion of which is covered by the sandpaper to form the exposed abrading surface.

13. The device in accordance with claim 1, wherein the sanding block comprises a deformable substrate at least a portion of which is covered by the sandpaper to form the exposed abrading surface.

14. The device in accordance with claim 1, wherein the porous member is deformable.

15. The device in accordance with claim 14, wherein the porous member is made from sponge or foam.

16. The device in accordance with claim 1, wherein the sandpaper is a layer affixed to at least a portion of the exposed abrading surface.

17. The device In accordance with claim 1, wherein the sandpaper is a coating applied to at least a portion of the exposed abrading surface.

18. The device in accordance with claim 1, wherein the sandpaper completely covers the exposed abrading surface.

19. The device in accordance with claim 1, wherein the collecting surface is substantially parallel with the exposed abrading surface.

* * * * *